US006109802A

United States Patent [19]

Iwama et al.

[11] Patent Number: 6,109,802

[45] Date of Patent: Aug. 29, 2000

[54] DOT LINE PRINTER FOR PREVENTING THE OVERHEATING OF PRINTING ELEMENTS BY SELECTIVELY ACTIVATING THE PRINTING ELEMENTS

[75] Inventors: Masami Iwama; Toshiyuki Suzuki, both of Hitachinaka, Japan

[73] Assignee: Hitachi Koki Co., Ltd., Tokyo, Japan

[21] Appl. No.: 09/110,241

[22] Filed: Jul. 6, 1998

[30] Foreign Application Priority Data

Jul. 4, 1997 [JP] Japan ..... P9-179784
Apr. 30, 1998 [JP] Japan ..... P10-121014

[51] Int. Cl.[7] ..... B41J 21/16

[52] U.S. Cl. ..... 400/279; 400/120.01; 400/120.05; 400/124; 400/283

[58] Field of Search ..... 400/279, 283, 400/124.13, 120.01, 120.05, 124

[56] References Cited

U.S. PATENT DOCUMENTS

| | | | |
|---|---|---|---|
| 4,653,940 | 3/1987 | Katsukawa | 400/121 |
| 5,152,619 | 10/1992 | Niikawa et al. | 400/124 |
| 5,458,424 | 10/1995 | Kato et al. | 400/279 |
| 5,662,421 | 9/1997 | Hagiwara et al. | 400/124.13 |
| 5,826,990 | 10/1998 | Suzuki et al. | 400/124.13 |

*Primary Examiner*—John S. Hilten
*Assistant Examiner*—Charles H. Nolan, Jr.
*Attorney, Agent, or Firm*—McGuire, Woods, Battle & Boothe, LLP

[57] ABSTRACT

In a dot line printer having a plurality of print hammers which are arranged to print a plurality of dot lines simultaneously when a hammer bank on which the print hammers are mounted performs one scan from one extreme to another, the dot lines originally assigned to the print hammers for printing are changed provided that a particular print hammer is driven an undue number of times when the originally assigned positions of the print hammers are maintained in the subsequent scans of the hammer bank.

14 Claims, 6 Drawing Sheets

DOT LINE PRINTER FOR PREVENTING THE OVERHEATING OF PRINTING ELEMENTS BY SELECTIVELY ACTIVATING THE PRINTING ELEMENTS

BACKGROUND OF THE INVENTION

1. Field of the Invention

The present invention relates generally to a dot line printer of the type in which a hammer bank containing a plurality of print hammers is moved reciprocally forward and backward along a print line by a shuttle mechanism.

2. Description of the Related Art

Dot line printers having a hammer bank that is moved reciprocally forward and backward along a print line are well known in the art. The hammer bank contains a plurality of print hammers juxtaposed along the print line and capable of printing a plurality of dot lines simultaneously as the hammer bank makes one scan along the print line from one extreme to another.

In the printers of this type, heat is generated from a hammer coil associated with a print hammer when a printing pattern calls for repeated driving of that print hammer. The heat generated from the hammer coil can reduce the service life of the print hammer parts. To resolve this problem, a circuit constructed as shown in FIG. 1 has been incorporated in the printer to control the printing process.

According to this circuit configuration, a print controller 15 controls the transfer of print data from a print data storage memory 21 to a print buffer 22. Simultaneously, the print data is sent to a counter 16 provided for counting the number of times each print hammer 14 is driven. A timer circuit 19 set to a fixed interval T1 is started at the beginning of the printing process and is restarted after the elapse of each interval T1. Each time the interval T1 elapses, the counter 16 is reset and the timer circuit 19 is restarted.

A comparator 17 compares the number of times each print hammer is driven, as counted by the counter 16, with a reference value that is latched in a data latch circuit 23 and detects when the number of times a print hammer is driven reaches the reference value. The reference value represents an allowable number of times a print hammer can be driven during each interval T1 without shortening the service life of the hammer parts. If the comparator 17 indicates that the number of drives for a print hammer as counted by the counter 16 has reached the reference value during an interval T1 of the timer circuit 19, a print halting unit 18 halts printing from the time of the detection until the current interval T1 of the timer circuit 19 has elapsed.

On the other hand, if the comparator 17 does not indicate that the number of drives for a print hammer, as counted by the counter 16, has reached the reference value, then the print halting unit 18 does not halt printing and printing continues. After the interval T1 of the timer circuit 19 has elapsed, the count set in the counter 16 is initialized to zero for each print hammer. The timer circuit 19 is restarted for another fixed interval T1 and printing continues.

FIG. 2 is an example of a timing chart showing print control according to the process described above.

In the example of FIG. 2, the timer circuit 19 is operated repeatedly for fixed intervals T1. As shown in the diagram, the number of times the print hammer is driven reaches the reference value during the first interval T1. When the comparator 17 detects that the number of drives has reached the reference value, printing is temporarily halted until the next timing interval T1 begins in order to prevent the hammer parts from becoming too hot. In the next time interval T1, the comparator 17 again detects that the number of times the print hammer is driven has reached the reference value, and printing is again halted until the next timing interval T1 begins.

Hence, according to the above-described technology, the drive number for each print hammer is counted during each specified timing interval T1. When the number of drives for a print hammer reaches the reference value, printing is halted until the next timing interval T1 begins in order that the service life of the print hammer will not be shortened by heat generated from the corresponding hammer coil.

However, not all printing patterns use all of the print hammers simultaneously. For example, as shown in FIG. 3, despite the fact that the print hammers can print N dot lines simultaneously as the hammer bank makes one scan from one extreme to another along the print line, only the upper half of the N dot lines are printed and the lower half of the N dot lines are not printed. That is, among the print hammers mounted on the hammer bank, a half of the print hammers for printing the lower half of the N dot lines are not used at all during each scan of the hammer bank whereas the rest of the print hammers are used for printing as indicated by shaded area in the diagram. When printing this type of pattern using the circuit configuration shown in FIG. 1, the printing process will be stopped even before the print hammers have reached the limits of their capability. Hence, printing speed and efficiency is lost.

SUMMARY OF THE INVENTION

In view of the foregoing, it is an object of the present invention to provide a dot line printer capable of minimizing speed and efficiency loss in printing by using the print hammers to the limit of their capabilities.

The above and other objects of the present invention will be attained by a dot line printer that includes a hammer bank that moves back and forth along a print line and accommodates a plurality of print hammers capable of printing a plurality of dot lines simultaneously with one scan of the hammer bank moving from one extreme to another, a shuttle mechanism for moving the hammer bank back and forth, printing means for performing a printing operation wherein the plurality of print hammers are selectively driven based on print data supplied on a block basis, a timer, print restriction detecting means, print halting means, expected drive number counting means, and print hammer changing means. The timer is set to a prescribed time and operates to measure the prescribed time when started. The print restriction detecting means is provided for starting the timer at specified intervals, counting the number of times each print hammer is driven while the timer is operating, and determining when the number of drive times counted reaches a reference value. The print halting means is provided for halting the printing operation from the time the print restriction detecting means detects the number of drive times for a print hammer has reached the reference value until the timer has completed operations. The expected drive number counting means is provided for counting the number of times each print hammer is expected to be driven. The print hammer changing means is provided for changing the dot lines originally assigned for printing to the plurality of print hammers according to the number of drive times and the expected number of drive times for each print hammer.

Further, analyzing means is provided for analyzing that a block of print data subject to printing during one scan of the hammer bank prints on the plurality of dot lines. The print hammer changing means is inoperable when the analyzing means indicates that the block of print data subject to printing during one scan of the hammer bank prints on the plurality of dot lines.

The printing means performs the printing operation during one scan of the hammer bank based on a block of print data. The prescribed time set to the timer is equal to or longer than a period of time during which the hammer bank performs two scans continuously.

A sum of the number of times a particular print hammer is driven based on a block of print data and the number of times the particular print hammer is expected to be driven based on another block of print data following the block of print data is reduced when the print hammer changing means changes the dot lines originally assigned to the plurality of print hammers. The print hammer changing means changes assignment of the dot lines to be printed by the plurality of print hammers so that the sum is reduced to a possible minimum.

The print restriction detecting means includes a counter provided for each of the plurality of print hammers, and a comparator having a first input receiving the number counted by the counter and a second input receiving the reference value.

According to another aspect of the invention, the plurality of print hammers are divided into a plurality of groups so that each group is assigned to print the same dot line, and the print restriction detecting means counts the number of times the print hammers belonging to each of the plurality of groups are driven while the timer is operating. The print restriction detecting means determines that the number of drive times counted reaches the reference value. The expected drive number counting means counts the number of times the print hammers belonging to each of the plurality of groups are expected to be driven. The print hammer changing means changes the dot lines originally assigned for printing to each of the plurality of groups according to the number of drive times and the expected number of drive times for each of the plurality of groups.

BRIEF DESCRIPTION OF THE DRAWINGS

The above and other objects, features and advantages of the present invention will become more apparent from the following description when taken in conjunction with the accompanying drawings, in which.

DETAILED DESCRIPTION OF THE PREFERRED EMBODIMENT

A dot line printer according to a preferred embodiment of the present invention will be described while referring to the accompanying drawings.

Figure 4:
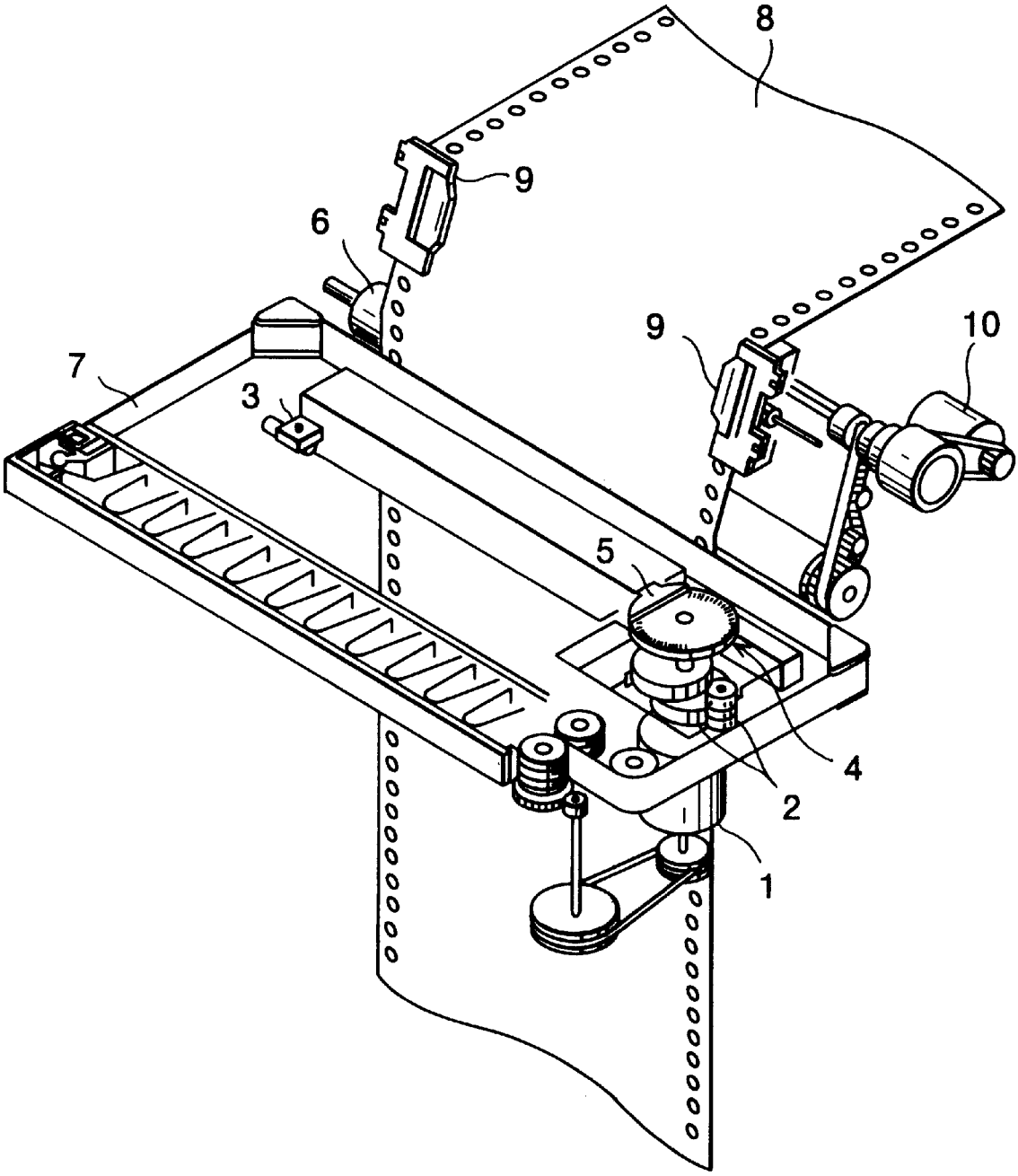
FIG. 4 is a perspective view showing an arrangement of a dot line printer.
Figure 5:
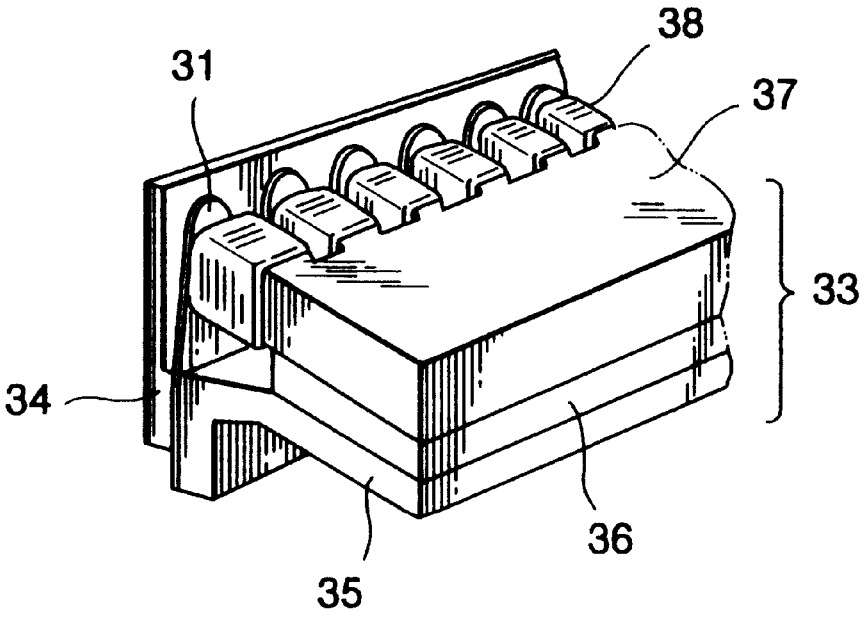
FIG. 5 is a perspective view showing print hammers.
Figure 6:
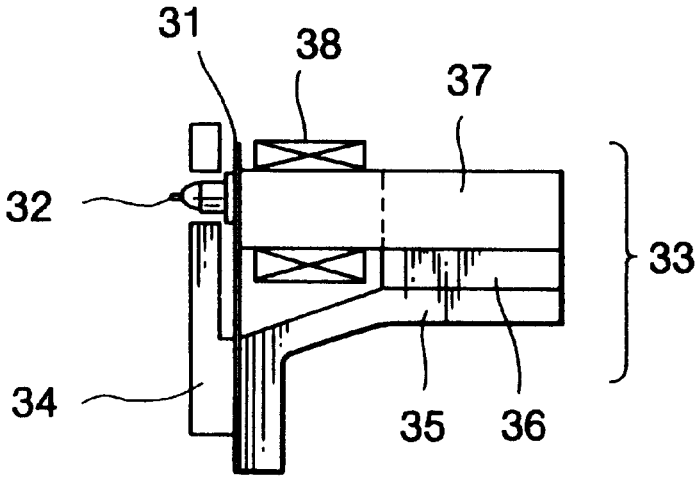
FIG. 6 is a side view showing the print hammer shown in FIG. 5.

A dot line printer has an arrangement generally as shown in FIG. 4. Although not shown in FIG. 4, a plurality of print hammers are contained in a hammer bank 3. As shown in FIGS. 5 and 6, the print hammer is a plate-like leaf spring 31 having a print pin 32 attached to free end portion (upper portion) of the leaf spring 31. Another portion (lower portion) of the leaf spring 31 is sandwiched between a front yoke 34 and a yoke base 35 and fixedly secured thereto by virtue of screws. A permanent magnet 36 and a comb-like yoke 37 are fixedly secured to the yoke base 35. The front yoke 34, leaf spring 31, yoke base 35, permanent magnet 36 and the comb-like yoke 37 constitute a magnetic circuit 33. The upper portion of the leaf spring 31 is magnetically attracted to the pole of the comb-like yoke 37 by virtue of the permanent magnet 36 against elastic deformation of the leaf spring 31. With energization of a release coil 38, the leaf spring 31 releases from the pole of the yoke 37 and the print pin 32 impinges upon a sheet of printing paper 8 (see FIG. 4), thereby making a dot impression thereon through an inking ribbon 7 (see FIG. 4).

As is well known in the art, a plurality of module structure print hammer assemblies are arranged in alignment with one another along the print line perpendicular to the direction in which the printing paper 8 is fed. Each print hammer assembly contains a plurality of print hammers, say N print hammers. Print pins 32 of those print hammers are displaced vertically or in the paper feeding direction from one another by a distance corresponding to one dot line so that N dot lines are simultaneously printed with each scan of the hammer bank 3.

Referring back to FIG. 4, the hammer bank 3 is driven by a shuttle motor 1 through a cam 2 and is reciprocated along the print line with a single rotation of the motor 1. A rotary encoder 4 formed with a predetermined number of angularly spaced slits is mounted on a cam shaft. A photocoupler 5 consisting of a light emitting diode and a photodiode is disposed in association with the rotary encoder 4 for detecting an angular displacement of the rotary encoder 4.

A platen 6 is rotatably supported on a printer frame (not shown) for supporting the printing paper 8 thereon. A pair of pin tractors 9 are disposed in side marginal portions of the printing paper 8, which upon engaging perforations formed on the printing paper 8, train the printing paper 8 while cooperating with the platen 6. The printing paper 8 is fed in the direction perpendicular to the direction in which the hammer bank 3 reciprocates. Both the platen 6 and the pin tractor 9 are driven by a paper feed motor 10.

Figure 7:
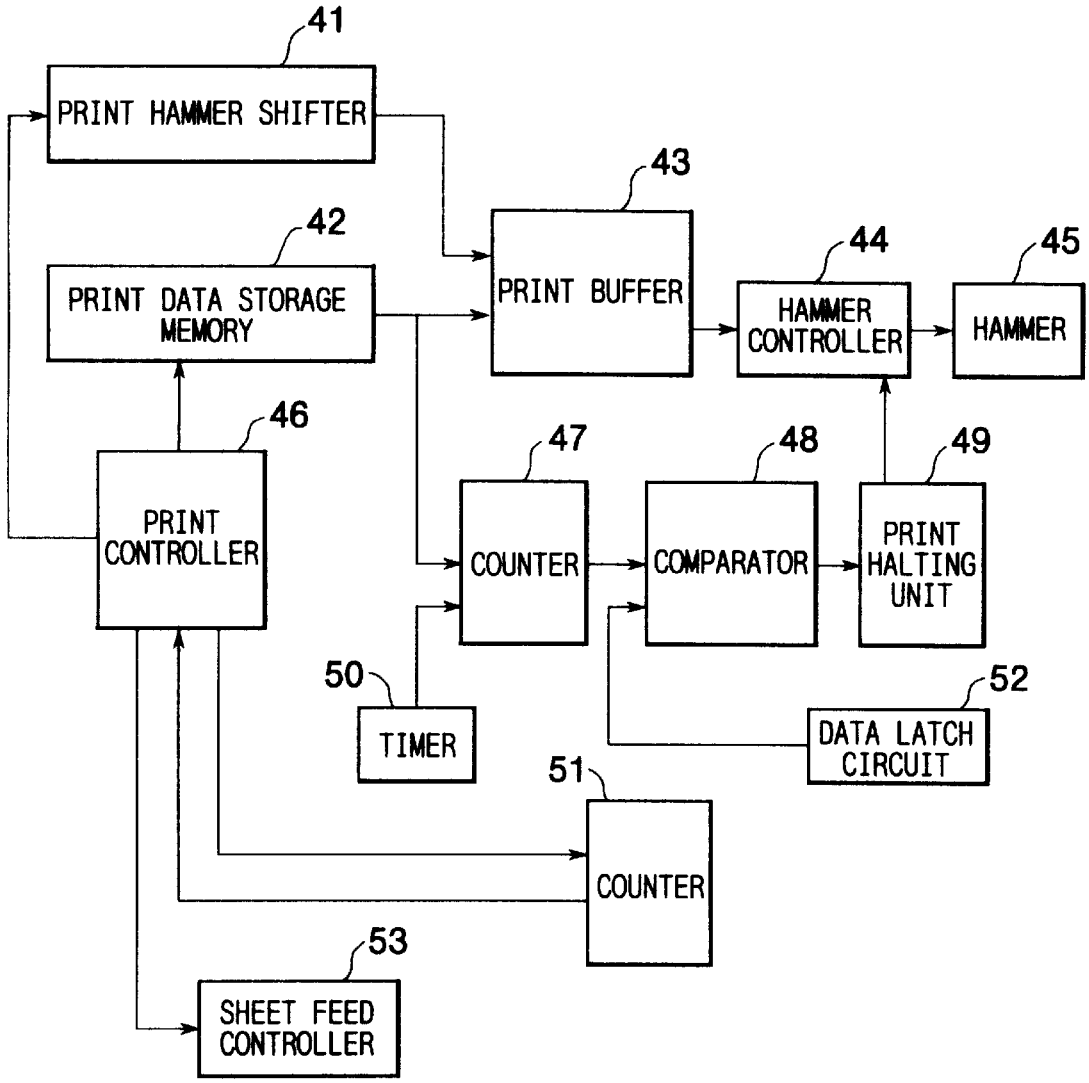
FIG. 7 is a block diagram showing a print control circuit for a dot line printer according to the present invention.

As shown in FIG. 7, the print control circuit of the present embodiment includes a print hammer shifter 41 described later, a print data storage memory 42 for storing print data, a print buffer 43 for temporarily storing the next section of print data to be printed, a plurality of print hammers 45 for making dot impressions on the printing paper to form images, a hammer controller 44 for selectively controlling driving of the hammers 45 according to the print data, a print controller 46 for controlling the transfer of print data, a counter 47 for counting the number of times each of the hammers 45 is driven, a counter 51 for counting the number of times each of the hammers 45 is expected to be driven, a timer 50 for establishing fixed intervals in which the counter 47 counts, a comparator 48 for comparing the counts in the counter 47 with a reference value, a data latch circuit 52 in which the reference value is latched, a print halting unit 49 for halting printing, and a sheet feed controller 53 for controlling the distance in which the printing paper is conveyed.

The print controller 46 stores print data in the print data storage memory 42 and transfers one scan of print data at a time to the print buffer 43. Here, a scan of print data is equivalent to the amount of data necessary for controlling all of the print hammers 45 as the hammer bank moves from one extreme to another. The print buffer 43 has a storage capacity equal to that needed to store dot data for printing one scan. Print buffer storage locations are established in the print buffer 43 to correspond to each of the print hammers used during printing operations. In order to execute a printing operation, the hammer controller 44 drives the print hammer 45 based on data stored in the print buffer 43.

At the same time print data is transferred from the print data storage memory 42 to the print buffer 43, the print data is also sent to the counter 47. The counter 47 counts the number of times each of the print hammers 45 is driven within a specified interval T1 timed by the timer 50. Since in the present embodiment the interval T1 is an interval long enough for the hammer bank 3 to perform a plurality of scans, that is, long enough to move from one extreme to another a plurality of times, the counter 47 adds and accumulates the number of times each print hammer 45 is driven during the plurality of scans executed within the interval T1. After each interval T1 has elapsed, the counter 47 is reset.

At the same time the counting process described above is being executed, the counter 51 counts the expected number of times each print hammer 45 will be driven in the next scan based on print data for the next scan transferred from the print data storage memory 42 through the print controller 46. Based on the count value for each print hammer 45 supplied from the counter 51, the print controller 46 determines whether the height of the print pattern to be printed in the next scan is smaller than, equal to, or greater than that corresponding to N dot lines capable of being printed simultaneously by the print hammers 45.

When the print controller 46 determines that the height of the print pattern is smaller than the height corresponding to N dot lines, the print controller 46 adds the expected number of times each print hammer 45 will be driven in the next scan to the number of times each print hammer 45 has been driven in the current interval T1 to find the greatest total value. This addition process is performed first by assuming the print hammers 45 of the first dot line will begin printing the print data. Next, the same addition process is performed assuming the print hammers 45 of the second dot line will begin printing the first dot line of data. This addition process is executed until the entire height of the printing pattern can no longer be completely printed by the remaining dot lines of print hammers 45. That is, the above pattern is repeated up to and including the addition process in which the last dot line of print hammers 45 is added to the last line of print data. Each time, the addition process is performed to find the greatest total value of the current number of drives and estimated number of drives. Based on these greatest total values, the print controller 46 determines the allocation of the print hammers 45 in the vertical direction so that the greatest total value is the lowest among the possible allocations of the corresponding print hammer. In order to achieve this minimum value, the print controller 46 changes the dot lines of print hammers 45 to be used in printing the print data, according to the optimal allocation determined above.

Next, the method of changing the dot lines of print hammers 45 used for printing will be described in detail.

Figure 1:
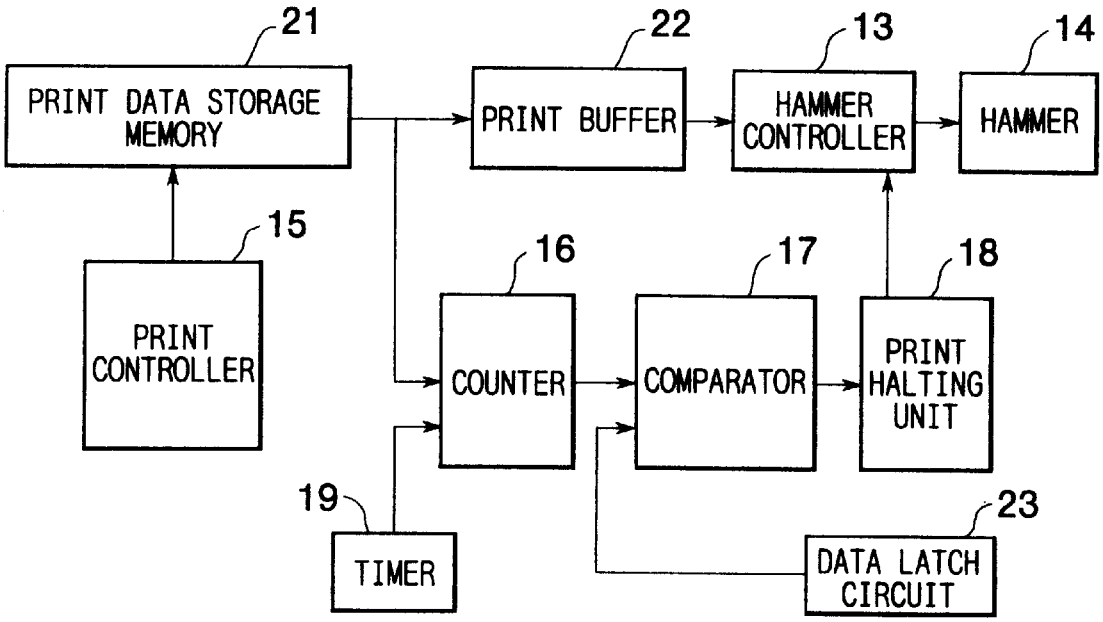
FIG. 1 is a block diagram showing a print control circuit for a dot line printer according to an earlier proposal by the present inventors.
Figure 2:
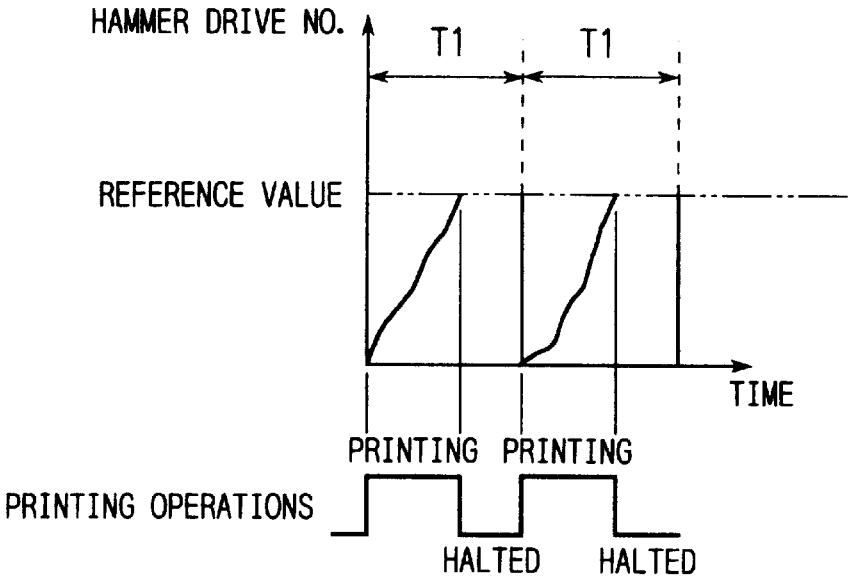
FIG. 2 is a timing chart showing an example of print control operations according to the circuit shown in FIG. 1.
Figure 3:
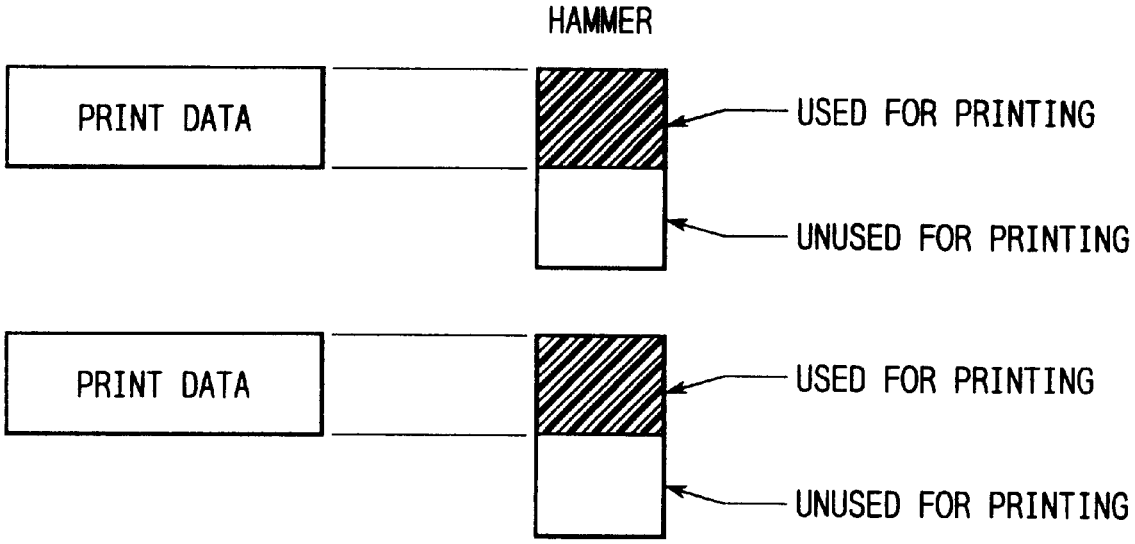
FIG. 3 is an explanatory diagram showing an example of printing operations.

In the process described above, the print controller 46 determines which of the dot lines of print hammers 45 will be used for printing data on the next scan and which of the dot lines of print hammers 45 will not be used. Based on this determination, the print controller 46 issues a command to the print hammer shifter 41 to transfer blank data, having no dots to be printed, to an area of the print buffer 43 corresponding to the print hammers 45 that will not be used for printing. However, if the comparator 48 detects that the drive number of a print hammer 45 counted by the counter 47 reaches the reference value latched in the data latch circuit 52, the print halting unit 49 halts printing from the time of the detection until the current interval T1 has elapsed, as in the method described in connection with FIG. 1.

Figure 8:
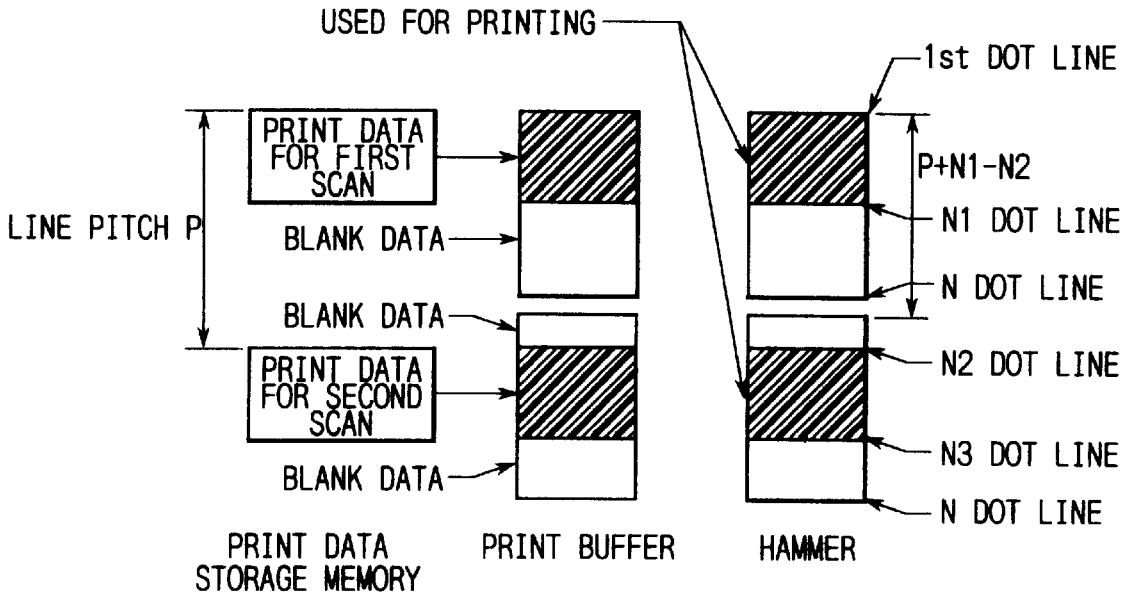
FIG. 8 is an explanatory diagram showing an example of printing operations according to the present invention.

Next, printing operations will be described with reference to FIG. 8. Before the printing process begins, the time interval T1 is initialized to a fixed time. Next, the print controller 46 transfers print data for the first scan, that is, print data from the first dot line to the N1 dot line, from the print data storage memory 42 to the print buffer 43. At the same time, the print controller 46 transfers blank data for the area from the N1+1 dot line to the N dot line where no dots are printed, from the print hammer shifter 41 to the print buffer 43. Next, a printing operation for one scan is executed using the print hammers 45 from the first dot line to the N1 dot line.

At the same time printing is begun, the timer 50 is started. The counter 47 counts the number of times each print hammer 45 is driven. The comparator 48 determines whether the drive number counted by the counter 47 has reached the reference value latched in the data latch circuit 52. If the drive number counted by the counter 47 for a print hammer 45 has reached the reference value, the print halting unit 49 temporarily halts the printing operation.

At the same time as the first scan, the counter 51 counts the expected drive number for each print hammer 45 to be driven in the second scan. Next, the print controller 46 determines the print hammers 45 to be used for printing data in the second scan by the repeated addition process described above. That is, the print controller 46 adds the expected number of times each print hammer 45 will be driven in the next scan to the number of times each print hammer 45 has been driven in the current interval T1, beginning by assuming the first dot line of print hammers 45 will begin printing the print data. The greatest total value is found in the repeated addition process. Based on the greatest total value, the dot lines of print hammers 45 used when the greatest total value is lowest is determined to be the optimal arrangement.

If it is determined, for example, that the smallest of the greatest total values is achieved by printing the data beginning from the N2 dot line of the print hammers 45, the print operation is adjusted to print the print data for the next scan using the print hammers 45 from the N2 dot line to the N3 dot line.

When performing actual printing on the second scan, print data for the N2 dot line to the N3 dot line of print hammers 45 is transferred from the print data storage memory 42. Blank data corresponding to the first dot line to the N2−1 dot line of print hammers 45 is transferred from the print hammer shifter 41. Similarly, blank data for the N3+1 dot line to the N dot line of print hammers 45 is transferred from the print hammer shifter 41. Hence, the printing data is managed in order to use the print hammers 45 from the N2 dot line to the N3 dot line for printing.

Further, in order to use print hammers 45 from the N2 dot line to print data for the second scan, as described above, it is also necessary to change the amount in which the paper is fed. In other words, while the printing paper is ordinarily conveyed a line pitch P of the printing data, as shown in FIG. 8, now the paper must be fed the line pitch P minus the distance to the N2 dot line (P−N2) in order to position the N2 dot line of the print hammers 45 at the beginning of the printing data.

At the same time the print hammers 45 used to print the second scan are determined, data specifying the distance to feed the printing paper is calculated by the print controller 46 before the second scan. This data is transferred by the print controller 46 to the sheet feed controller 53. Based on this data, the sheet feed controller 53 feeds the paper the necessary distance immediately before the second scan.

The third scan is performed exactly like the second scan. At the same time the printing operation is executed for the second scan, the counter 51 counts the estimated drive number for each print hammer 45 of the third scan. Next, the addition process describe above is performed, in which the number of drives for each print hammer in the first and second scans plus the estimated number of drives for that print hammer 45 in the third scan is totaled. The greatest total value is found each time the addition process is performed. The optimal print hammers 45 to be used for printing the third scan are set based on the smallest of the greatest total values found above. Next, the printing operation is executed for the third scan.

Figure 9:
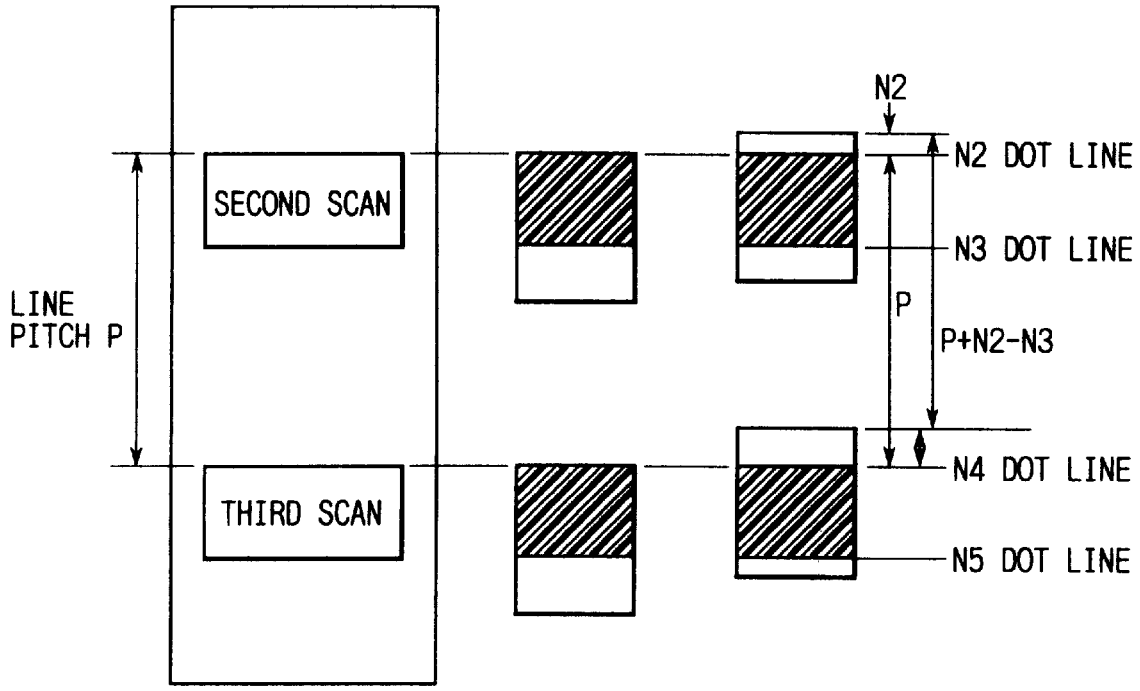
FIG. 9 is an explanatory diagram showing an example of paper feed control in printing operations according to the present invention.

FIG. 9 shows the adjustments made to feed the printing paper directly before printing data in the third scan. Assuming that P is the original line pitch for the print data, N2 is the dot line at which printing was actually begun for the second scan, and N4 is the dot line to begin printing of the third scan, the distance that the printing paper is conveyed before printing the third scan is P+N2−N4. The print controller 46 controls the conveying of the printing paper as soon as the print hammers 45 to be used for printing the next scan have been determined. The print controller 46 transfers data specifying the distance for feeding the printing paper to the sheet feed controller 53, which conveys the paper the necessary distance immediately before the third scan is printed.

The above process is repeated over several scans during the interval T1 set by the timer 50. However, if the drive number counted by the counter 47 for each of the print hammers is determined to reach the reference count number during the interval T1, then the print halting unit 49 halts the printing operation from the time of detection until the current interval T1 has elapsed.

After the interval T1 has elapsed, the drive number for each of the print hammers is reset to zero. The interval T1 is reset. Once again the first dot line of the print hammers 45 is established at the beginning of the print data in the next scan, and printing continues.

In the embodiment described above, print hammers to be used for printing are changed according to the number of drives counted for each print hammer. However, it is also possible to divide the print hammers into a plurality of groups and to change the print hammer groups used for printing based on the drive number counted for each of the plurality of print hammer groups.

Hence, in a dot line printer capable of printing several dot lines in one scan across the printing paper, the print hammers are divided into groups. For example, the print hammers in the first dot line are group 1; the print hammers in the second dot line are group 2; and so on. In this case, the print hammers of group 1 are controlled such that they are not used when the number of drives counted for group 1 becomes too large. Instead of printing the next print data beginning with group 1, printing is performed beginning from the print hammers of group 2 or greater. This method has the same effects as the embodiment described above.

As described above, a dot line printer of the present invention is capable of minimizing speed loss and efficiency loss in printing by using the print hammer parts up to the limit of their capabilities without shortening the service life of the print hammers.

While one exemplary embodiment of this invention has been described in detail, those skilled in the art will recognize that there are many possible modifications and variations which may be made in this exemplary embodiment while yet retaining many of the novel features and advantages of this invention. Accordingly, all such modifications and variations are intended to be included within the scope of the appended claims.

What is claimed is:

1. A dot line printer comprising:

a hammer bank that moves back and forth along a print line and accommodates a plurality of print hammers capable of printing a plurality of dot lines simultaneously with one scan of the hammer bank moving from one extreme to another;

a shuttle mechanism for moving the hammer bank back and forth;

printing means for performing a printing operation wherein the plurality of print hammers are selectively driven based on print data supplied on a block basis;

a timer operating to measure a prescribed time when started;

print restriction detecting means for starting the timer at specified intervals, counting the number of times each print hammer is driven while the timer is operating, and determining when the number of drive times counted reaches a reference value;

print halting means for halting the printing operation from the time the print restriction detecting means detects the number of drive times for a print hammer has reached the reference value until the timer has completed measuring the prescribed time;

expected drive number counting means for counting the number of times each print hammer is expected to be driven;

print hammer changing means for changing the dot lines originally assigned for printing to the plurality of print hammers according to the number of drive times and the expected number of drive times for each print hammer; and sheet feed controller means for changing the line pitch at which paper is fed through said printer based on the change in dot lines.

2. The dot line printer according to claim 1, further comprising analyzing means for analyzing that a block of print data subject to printing during one scan of the hammer bank prints on the plurality of dot lines, wherein the print hammer changing means is inoperable when the analyzing means indicates that the block of print data subject to printing during one scan of the hammer bank prints on the plurality of dot lines.

3. The dot line printer according to claim 2, wherein the printing means performs the printing operation during one scan of the hammer bank based on a block of print data.

4. The dot line printer according to claim 3, wherein the prescribed time set to the timer is equal to or longer than a period of time during which the hammer bank performs two scans continuously.

5. The dot line printer according to claim 1, wherein a sum of the number of times a particular print hammer is driven based on a block of print data and the number of times the particular print hammer is expected to be driven based on another block of print data following the block of print data is reduced when the print hammer changing means changes the dot lines originally assigned to the plurality of print hammers.

6. The dot line printer according to claim 5, wherein the print hammer changing means changes assignment of the dot lines to be printed by the plurality of print hammers so that the sum is reduced to a possible minimum.

7. The dot line printer according to claim 1, wherein the print restriction detecting means comprises a counter provided for each of the plurality of print hammers, and a comparator having a first input receiving the number counted by the counter and a second input receiving the reference value.

8. A dot line printer comprising:

a hammer bank that moves back and forth along a print line and accommodates a plurality of print hammers capable of printing a plurality of dot lines simultaneously with one scan of the hammer bank moving from one extreme to another, the plurality of print hammers being divided into a plurality of groups, each of the plurality of groups being assigned to print the same dot line;

a shuttle mechanism for moving the hammer bank back and forth;

printing means for performing a printing operation wherein the plurality of print hammers are selectively driven based on print data supplied on a block basis;

a timer operating to measure a prescribed time when started;

print restriction detecting means for starting the timer at specified intervals, counting the number of times the print hammers belonging to each of the plurality of groups are driven while the timer is operating, and determining when the number of drive times counted reaches a reference value;

print halting means for halting the printing operation from the time the print restriction detecting means detects the number of drive times has reached the reference value until the timer has completed measuring the prescribed time;

expected drive number counting means for counting the number of times the print hammers belonging to each of the plurality of groups are expected to be driven;

print hammer changing means for changing the dot lines originally assigned for printing to each of the plurality of groups according to the number of drive times and the expected number of drive times for each of the plurality of groups; and sheet feed controller means for changing the line pitch at which paper is fed through said printer based on the change in dot lines.

9. The dot line printer according to claim 8, further comprising analyzing means for analyzing that a block of print data subject to printing during one scan of the hammer bank prints on the plurality of dot lines, wherein the print hammer changing means is inoperable when the analyzing means indicates that the block of print data subject to printing during one scan of the hammer bank prints on the plurality of dot lines.

10. The dot line printer according to claim 9, wherein the printing means performs the printing operation during one scan of the hammer bank based on a block of print data.

11. The dot line printer according to claim 10, wherein the prescribed time set to the timer is equal to or longer than a period of time during which the hammer bank performs two scans continuously.

12. The dot line printer according to claim 8, wherein a sum of the number of times the print hammers belonging to a particular group are driven based on a block of print data and the number of times the print hammers belonging to the particular group are expected to be driven based on another block of print data following the block of print data is reduced when the print hammer changing means changes the dot lines originally assigned to each of the plurality of groups.

13. The dot line printer according to claim 12, wherein the print hammer changing means changes assignment of the dot lines to be printed by the plurality of groups so that the sum is reduced to a possible minimum.

14. The dot line printer according to claim 8, wherein the print restriction detecting means comprises a counter provided for each of the plurality of groups, and a comparator having a first input receiving the number counted by the counter and a second input receiving the reference value.

* * * * *